US010975624B2

(12) United States Patent
Bamford et al.

(10) Patent No.: US 10,975,624 B2
(45) Date of Patent: Apr. 13, 2021

(54) MATERIALS HANDLING VEHICLE

(71) Applicant: JC Bamford Excavators Limited, Staffordshire (GB)

(72) Inventors: Anthony Paul Bamford, Uttoxeter (GB); Timothy John Burnhope, Uttoxeter (GB)

(73) Assignee: JC Bamford Excavators Limited, Uttoxeter (GB)

( * ) Notice: Subject to any disclaimer, the term of this patent is extended or adjusted under 35 U.S.C. 154(b) by 0 days.

(21) Appl. No.: 14/574,090

(22) Filed: Dec. 17, 2014

(65) Prior Publication Data

US 2015/0167391 A1 Jun. 18, 2015

(30) Foreign Application Priority Data

Dec. 18, 2013 (GB) ..... 1322350

(51) Int. Cl.

| | |
|---|---|
| ***B60P 1/04*** | (2006.01) |
| ***E21B 7/02*** | (2006.01) |
| ***E21B 19/087*** | (2006.01) |
| ***E02F 3/06*** | (2006.01) |
| ***E02D 7/06*** | (2006.01) |
| ***E21B 10/44*** | (2006.01) |

(52) U.S. Cl.

CPC ..... *E21B 7/023* (2013.01); *E02D 7/06* (2013.01); *E21B 7/024* (2013.01); *E21B 7/027* (2013.01); *E21B 10/44* (2013.01)

(58) Field of Classification Search

CPC .. E02D 7/06; E02F 9/22; E02F 9/2257; E02F 3/03; E21B 7/02

USPC ..... 405/232; 414/543, 550

See application file for complete search history.

(56) References Cited

U.S. PATENT DOCUMENTS 2,795,342 A * 6/1957 Steele ..... 414/550
2,856,158 A * 10/1958 Richardson et al. ... E21B 10/02 175/394
3,213,948 A * 10/1965 Eckels ..... B66C 13/18 138/110

(Continued)

FOREIGN PATENT DOCUMENTS

GB 2376248 A 12/2002
WO WO-2013/093511 A1 6/2013

OTHER PUBLICATIONS

Search Report for GB 1322350.8, dated Jul. 10, 2014.

(Continued)

*Primary Examiner* — Tara Mayo-Pinnock
(74) *Attorney, Agent, or Firm* — Marshall, Gerstein & Borun LLP

(57) ABSTRACT

A materials handling vehicle having a chassis, two front ground engaging wheels, two rear ground engaging wheels, a front loading arm pivotally mounted relative to the chassis about a generally horizontal front loading arm axis extending laterally relative to the vehicle, a rear arm being a single rigid rear arm and being pivotally mounted at a first end relative to the chassis about a generally horizontal first axis, the rear arm being pivotable relative to the chassis about a generally vertical second axis and a piling rig for removing spoil to form a hole, the piling rig being pivotally mounted at a second end of the rear arm about a generally horizontal third axis extending laterally relative to the arm.

17 Claims, 3 Drawing Sheets

(56) References Cited

U.S. PATENT DOCUMENTS 3,252,523 A * 5/1966 Kachnik et al. ..... E02F 3/96 172/445.2
3,327,789 A * 6/1967 Furuseth ..... E21B 3/02 173/159
3,604,521 A * 9/1971 Collins ..... E21B 19/087 173/38
3,700,045 A 10/1972 Coontz
3,868,035 A * 2/1975 Broyles ..... 414/699
4,066,134 A * 1/1978 Karns, III ..... E02F 3/961 173/27
4,299,530 A * 11/1981 Schaeff ..... B62D 49/085 172/611
5,012,873 A * 5/1991 Kennedy ..... E02D 7/10 173/185
5,236,054 A * 8/1993 Jack et al. ..... 175/57
5,450,912 A * 9/1995 Cahill ..... E04H 12/2292 173/192
5,544,978 A * 8/1996 Albers ..... 405/232
5,778,569 A * 7/1998 Schaeff ..... B60G 17/005 180/418
6,155,359 A * 12/2000 Gardner ..... E21B 7/005 173/27
6,234,719 B1 * 5/2001 Roynestad ..... E02D 7/26 173/1
6,409,457 B1 * 6/2002 Korycan et al. ..... 414/501
6,675,916 B1 1/2004 Mathews
7,036,606 B2 * 5/2006 Rossi ..... E21B 7/005 172/25
7,448,838 B2 * 11/2008 Bunting ..... 414/23
2003/0037940 A1 2/2003 Howell
2004/0031617 A1 * 2/2004 Skarlupka, IV ..... E21B 7/028 173/184
2011/0091285 A1 4/2011 Thurner et al.

OTHER PUBLICATIONS

Office Action issued in Indian Patent Application No. 3541/DEL/2014, dated Oct. 3, 2019.
Office Action issued in Brazilian Patent Application No. BR102014031871.2, dated Mar. 26, 2020.

* cited by examiner

MATERIALS HANDLING VEHICLE

BACKGROUND OF THE INVENTION

The present invention relates to a materials handling vehicle, in particular a materials handling vehicle known as a back hoe loader.

SUMMARY OF THE INVENTION

According to a first aspect of the present invention there is provided a materials handling vehicle having a chassis, two front ground engaging wheels, two rear ground engaging wheels, a front loading arm pivotally mounted relative to the chassis about a generally horizontal front loading arm axis extending laterally relative to the vehicle, a rear arm being a single rigid rear arm and being pivotally mounted at a first end relative to the chassis about a generally horizontal first axis, the rear arm being pivotable relative to the chassis about a generally vertical second axis and a piling rig for removing spoil to form a hole, the piling rig being pivotally mounted at a second end of the rear arm about a generally horizontal third axis extending laterally relative to the arm.

According to a second aspect of the present invention there is provided a method of operating a materials handling vehicle as defined in an the first aspect including:

a) with the rear arm in a first position, commencing piling the ground proximate the first end of the rear arm so as to collect spoil in the piling rig and create a piled hole, b) disengaging the piling rig from the piled hole, c) pivoting the rear arm downwards, and d) discarding the spoil remote from the piled hole.

The piling rig may be a rotary celibar piling rig. The piling rig may be an auger piling rig such as a continuous flight auger piling rig.

BRIEF DESCRIPTION OF THE DRAWINGS

The present invention will now be described, with reference to the accompanying drawings, in which.

DETAILED DESCRIPTION OF THE INVENTION

Figure 7:
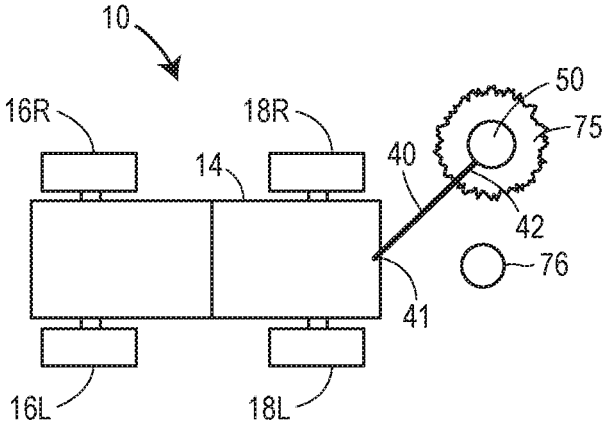
FIG. 7 shows a schematic plan view of the materials handling vehicle of FIG. 1 where the piling rig has been manoeuvred to a different position.

With reference to the figures there is shown a materials handling vehicle 10 including a chassis 12, a cab 14, a pair of front wheels 16L, 16R (see FIG. 7), a pair of rear wheels 18L, 18R (see FIG. 7). The pair of front wheels and pair of rear wheels include elastomeric tyres, in this case pneumatic tyres. The cab includes an operator seat 20 and a steering wheel 22. The cab also includes various controls 24 and 25 which enable an operator to operate the machine.

Mounted on the chassis at the front of the machine is a loader arm 28 which is pivotally mounted to the chassis at pivot 29 which has an axis which is horizontally orientated relative to the chassis and extends laterally relative to the chassis. The loader arm 28 can be raised and lowered by operation of actuator 30. Mounted on the front of the loader arm 28 is an implement 31, which in this case is a loading shovel. The loading shovel is pivotable about a generally horizontal axis via pivot 32 relative to the loading arm. A linkage mechanism 33 including at least links 34, 35 and 36 and hydraulic ram 37 is operable to selectively pivot the loading shovel 31 relative to the loader arm 28. The loader arm 28, implement 31, and linkage mechanism 33 and their attachment to the machine and operation are well known in the art.

The vehicle 10 also includes a rear arm 40 (also known as a boom). In this case the rear arm 40 is a single rear arm and is a rigid rear arm. The rear arm has a first end 41 and a second end 42. The rear arm 40 is pivoted about a pivot 43 relative to an arm mount 44. The axis of pivot 43 is horizontal. The arm mount 44 is pivotally mounted about pivot 45 relative to a carriage 46. Pivot 45 has an axis which is vertical. The carriage 46 is slideably mounted relative to the chassis such that the carriage can move laterally relative to the chassis.

An actuator (not shown) can be operated to slide the carriage laterally relative to the chassis to any desired position. An actuator (not shown) can be selectively operated to pivot the arm mount 44 about pivot 45 to any desired location. An actuator (not shown) can be selectively operated to pivot the rear arm 40 relative to the arm mount about pivot 43 to any desired position.

A piling rig 50 (shown schematically) is pivotally mounted via pivot 51 to the rear arm 40. The pivot 51 is positioned near the second end 42 of the rear arm. Pivot 51 has an axis which is horizontal. An actuator 52 is selectively operable to pivot the piling rig about pivot 51 relative to the rear arm 40.

Piling rigs are known, examples of which are rotary kelly bar piling rigs and an auger or CFA (continuous flight auger) piling rig. Such piling rigs operate by removing spoil to form a hole in the ground. Piling rig 50 may be a drilling piling rig, an auger piling rig, or any other type of piling rig which removes spoil to form a hole.

Figure 6:
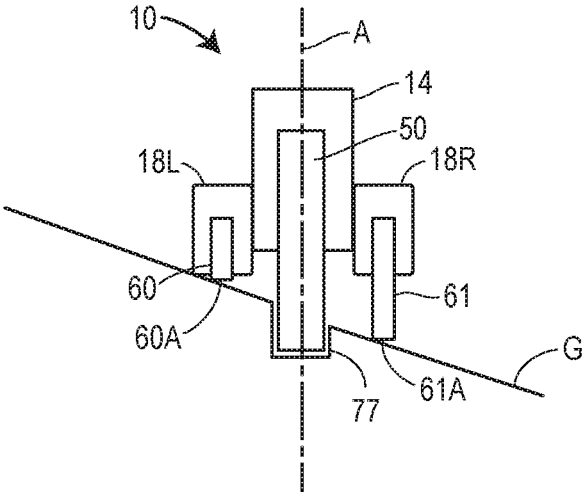
FIG. 6 shows a schematic rear view of the materials handling vehicle of FIG. 1 when positioned on a side slope.

The vehicle 10 also includes rear stabilisers 60 and 61 (see FIG. 6). Stabiliser 60 is mounted on the right hand side of the vehicle and stabiliser 61 is mounted on the left hand side of the vehicle. Each stabiliser has a stabiliser foot 60A, 61A which is selectively engageable with the ground. Operator controls allow the stabiliser 60 to be selectively extended from a retracted position to a position where the foot 60A engages the ground. Similarly, the stabiliser 61 may be selectively extended from a retracted position to a position where foot 61A engages the ground. The stabilisers 60 and 61 are independently extendible, and therefore when the vehicle is on uneven ground, the operator can "level" the vehicle in a lateral sense by differentially extending stabilisers 60 and 61. Typically the operator will extend the stabilisers such that the rear wheels 18 are off the ground or only in relatively light contact with the ground. In other words, typically the stabilisers will be extended such that the majority of or all the weight of the rear of the vehicle is being supported by the stabilisers and only a small proportion, or none of the weight of the rear of the vehicle is being supported by the wheels 18. This is because the rear wheels 18 typically include a tyre such as a pneumatic tyre which has been designed to be flexible to provide suspension of the vehicle when it is in a transport mode and travelling from one location to another. However, when the vehicle is stationary and the piling rig is in use, the flexibility of the tyre is no longer required, rather it is beneficial to minimise any movement of the rear of the vehicle during piling, and accordingly by supporting the weight of the rear of the vehicle on the stabilisers this minimises movement of the rear of the vehicle.

The arrangement of the vehicle 10 results in a very versatile vehicle which is able to remove spoil to form a hole using the piling rig 50 in a number of different ways.

Figure 2:
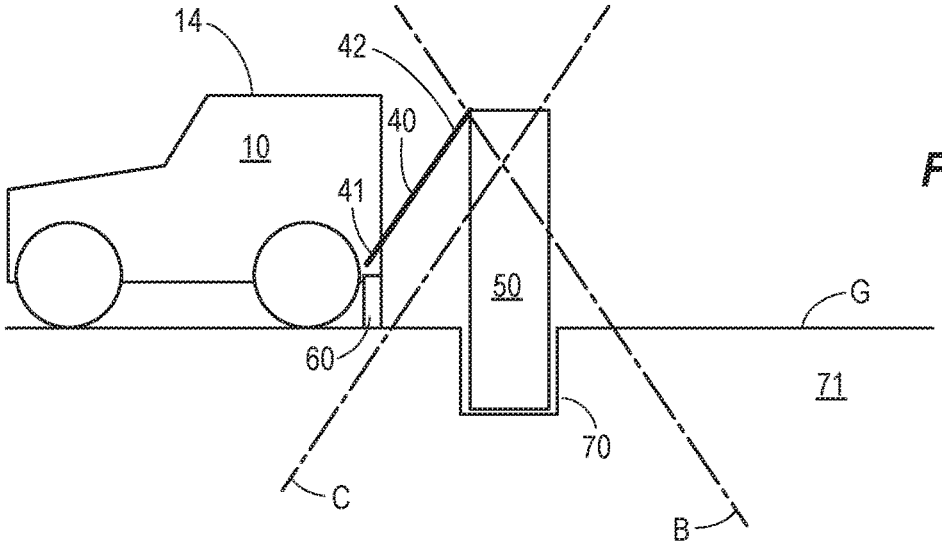
FIGS. 2 to 5 show schematic side views of the materials handling vehicle of FIG. 1 wherein the piling rig has been manoeuvred to different positions.

As shown in FIG. 2, the rear arm 40 is in a raised position and the ram 52 has been operated such that the piling rig is orientated vertically. Under these circumstances the piled hole 70 is relatively close to the back of the vehicle, and in particular relatively close to the stabilisers 60 and 61. Thus, the chassis 12 and rear arm 40, which can be considered to be a "drilling platform" is relatively close to the piled hole 70 and therefore this is a stable arrangement.

Figure 3:
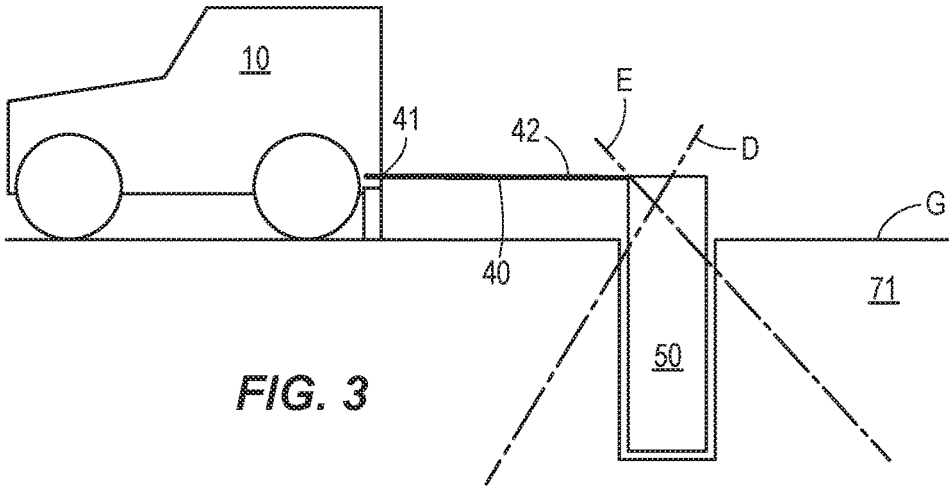

As shown in FIG. 3, the rear arm 40 is generally horizontal and the second end 42 is closer to the ground than when the rear arm 40 is in the raised position shown in FIG. 2. As shown in FIG. 3, the actuator 52 has been operated to ensure that the piling rig 50 piles a vertical hole. As shown in FIG. 3 a deeper hole can be piled than as shown in FIG. 2, since in FIG. 3 the top of the piling rig is closer to the ground than in FIG. 2.

Figure 4:
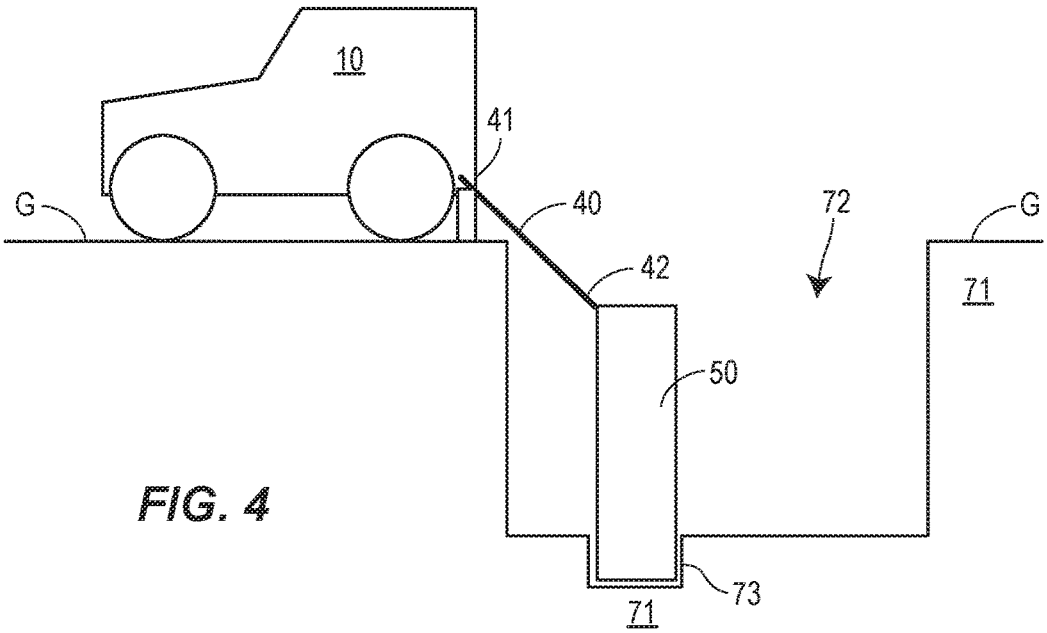

As shown in FIG. 4 the rear of the vehicle 10 has been positioned near the edge of a pre-existing trench 72 in the ground. Under these circumstances the rear arm slopes downwardly, in other words the second end 42 of the rear arm is positioned lower than the first end 41 of the rear arm. Under these circumstances the piled hole 73 can be made deeper when considering the nominal ground level G than a hole which is piled when the rear arm 40 is generally horizontal as shown in FIG. 3 and also deeper than a piled hole when the rear arm 40 is in the raised position as shown in FIG. 2.

Figure 5:
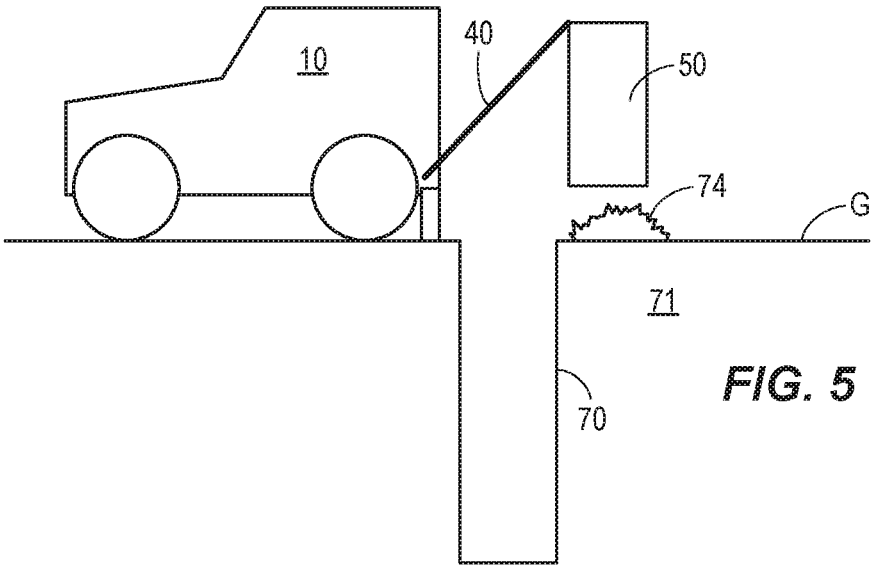

When the piling rig 50 is an auger piling rig, then the piling operation is such that the auger partially piles the hole by drilling downwardly. The auger itself then fills with spoil material and this spoil material then has to be removed from the auger before further piling can continue. Thus, in order to remove the spoil material from the auger, the auger itself is withdrawn from the piled hole and moved to a position where the spoil can be dumped. Thus, FIG. 2 shows a partially piled hole 70. If the piler rig 50 is an auger piling rig, then the auger can be withdrawn from partially piled hole and the rear arm 40 can be lowered to the position shown in FIG. 5 whereupon the spoil in the auger can then be dumped to form a spoil pile 74. The rear arm 40 can then be raised to the FIG. 2 position and piling can recommence. By continually partially piling the hole and dumping the spoil from the auger onto the spoil pile 74 the piled hole 70 can progressively be piled to a greater depth (compare the depth of hole 70 shown in FIG. 5 with depth of hole 70 shown in FIG. 2).

Because the rear arm 40 is mounted on arm mount 44 which is pivotable via pivot 45 about a generally vertical axis, then the spoil pile need not be positioned behind the vehicle. FIG. 7 shows a spoil pile 75 which is positioned towards the side of the vehicle and away from piled hole 76. If necessary the spoil pile 75 can be positioned yet further away from the piled hole 76 by selectively moving the carriage 46 to the right of the vehicle prior to the dumping the spoil on the ground.

The stabilisers can be used to orientate the axis of the hole to be piled, thus as shown in FIG. 6 the ground slopes downwardly from left to right when viewing the figure. However, the vehicle has been levelled because stabiliser 61 has been extended further than the stabiliser 60. As can be seen from the figure the right rear wheel 18R is further off the ground than the left rear wheel 18L. The axis A of the piled hole 77 is vertical. As will be appreciated, if the desired axis of the hole to be piled is not vertical, then this can be accommodated by selective extension or retraction of the appropriate stabilisers 60 or 61.

As mentioned above, by differentially extending and retracting appropriate stabilisers, it is possible to pile a hole having an axis inclined laterally relative to the ground level. However, because the piling rig is pivotable about pivot 51, then the axis of a hole to be piled can selectively be angled in a forwards or backwards direction relative to the vehicle. Thus, as can be seen from FIG. 2, whilst pile 50 is piling a vertical hole, the actuator 52 could alternatively be arranged to position the piling rig to pile a hole having an axis B or alternatively the axis could be as shown at C. Clearly a hole having an axis between axis B and C could also be piled. Similarly, as shown in FIG. 3, the piling rig 50 is arranged to pile a vertical hole but alternatively it could be arranged to pile a hole having an axis D or an axis E or any axis between axes D and E.

The applicant is the first to appreciate that mounting a piling rig on a rear boom of a back hoe loader in place of the rear dipper provides a particularly versatile vehicle for removing spoil to form a piled hole. In particular it is not necessary to be able to pivot the piling rig laterally relative to the rear boom, since lateral alignment of the rig can be accomplished by utilising the stabilisers of the back hoe loader.

Furthermore, it has been known when piling deep holes, in "sticky" material such as clay, for the piling rig to jam in the piled hole.

For known piling rigs mounted on vehicles, the hydraulic system must be capable of withdrawing a "stuck" piling rig, in other words the hydraulic actuators that are associated with manipulation of the arms that hold the piling rig must be sufficiently powerful to withdraw a "stuck" piling rig.

However, the present applicant is the first to realise that rather than raising the "stuck" piling rig relative to the vehicle, it is possible to simply lift the whole vehicle. Lifting of the vehicle will cause a corresponding lifting of the piling rig. The applicant is the first to realise that it is possible to lift both piling rig and vehicle of the present invention by operating the stabilisers, i.e. "lowering" the stabilisers further even though they are already in engagement with the ground. Thus, as shown in FIG. 2, the piling rig 50 is in engagement with the ground and is positioned in the piled hole 70. The stabilisers 60 and 61 have already been lowered and are in engagement with the ground (this was carried out prior to starting piling the hole). Should the piling rig 50 become "stuck" in the hole 70, then the stabilisers 60 and 61 can be further "lowered". As will be appreciated, rather than the stabilisers 60 and 61 being lowered down, the rear of the vehicle is simply lifted up thereby partially withdrawing, and hence "unsticking" the piling rig 50 from the hole 70. As is known, once the piling rig has been partially withdrawn from the hole this is typically sufficient to "unstick" it from the hole and then further withdrawal of the piling rig from the hole can be carried out using the hydraulics of the piling rig itself. Because the stabilisers 60 and 61, and in particular the actuators operating the stabilisers are sized to stabilise the whole vehicle, then typically this means that they are sufficiently large to "unstick" a piling rig.

Figure 1:
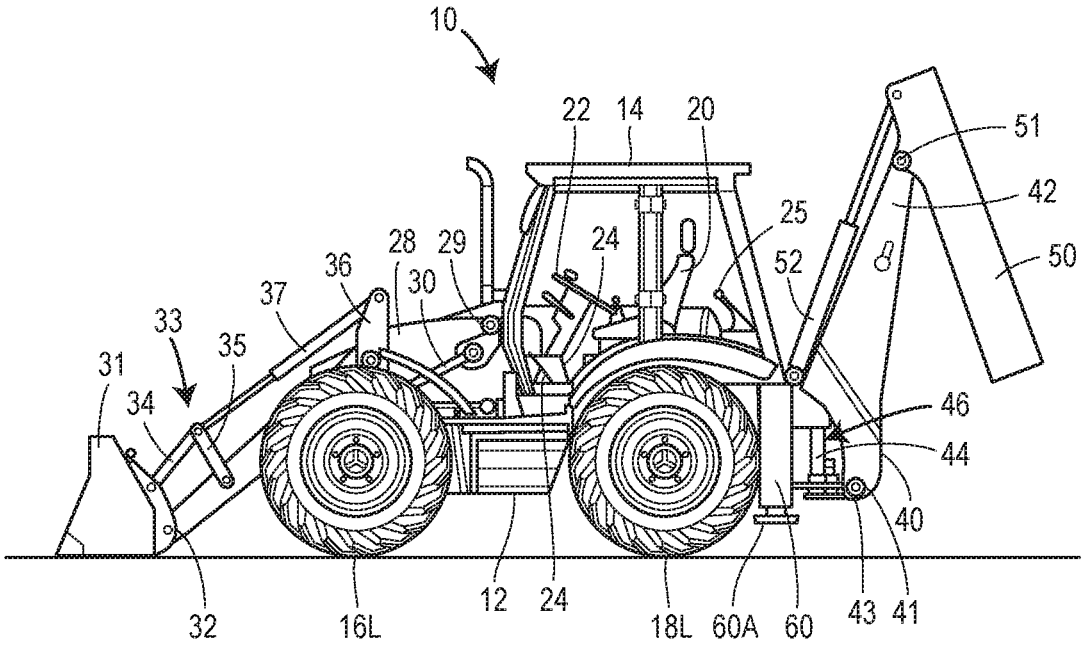
—FIG. 1 shows a side view of a materials handling vehicle according to the present invention.

As shown in FIG. 1, pivot 51 which attaches the piling rig 50 to the rear arm 40 is in the form of one or more holes in the piling rig being aligned with one or more holes in the rear arm 40 through which holes pass a pivot pin. In further embodiments the piling rig could be attached to a bracket (known as a quick hitch attachment) which is pivotable on rear arm 40. The pile rig 50 would be rigidly attached to the bracket (quick hitch attachment).

Quick hitch attachments are known and enable implements to be quickly attached and detached from arms of material handling vehicles.

As described above, a loading shovel is mounted on the front of the loader arm 28. In further embodiments alternative implements may be attached in front of the loading arm 28, for example loading forks a lift attachment or other implements. In particular the implement may be attached to the loading arm 28 with a quick hitch.

The invention claimed is:

1. A materials handling vehicle having a chassis, two front ground engaging wheels, two rear ground engaging wheels, a front loading arm pivotally mounted relative to the chassis about a generally horizontal front loading arm axis extending laterally relative to the vehicle, a rear arm, the rear arm being only a single non-articulating rear arm, the rear arm having a first end pivotally mounted relative to the chassis and a second end spaced a fixed distance away from the first end, wherein all of the rear arm is vertically pivotable relative to the chassis about only a single generally horizontal first axis, the rear arm also being horizontally pivotable relative to the chassis about only a single generally vertical second axis, and including a rotary piling rig for removing spoil to form a hole, the rotary piling rig being pivotally mounted directly to the second end of the rear arm and arranged to pivot about a generally horizontal third axis extending parallel relative to the first axis, and wherein all of the rotary piling rig pivots vertically relative to the rear arm about only the third axis and further wherein, due to the fixed distance between the second end and the first end, the first axis and the third axis are spaced apart by a constant distance.

2. The materials handling vehicle as defined in claim 1, and including a chassis tipping system operable to tip the chassis laterally, and wherein the chassis tipping system includes a right ground engaging stabilizing leg and a left ground engaging stabilizing leg, the right and left ground engaging stabilizing legs being differentially extendable.

3. The materials handling vehicle as defined in claim 1 in which the front loading arm includes a materials handling implement engageable with the ground to tip the chassis longitudinally.

4. The materials handling vehicle as defined in claim 3 in which the materials handling implement is a loading shovel or a loading fork or a loading tine.

5. The materials handling vehicle as defined in claim 1 in which the rear arm is mounted on a carriage, the carriage being translatable laterally relative to the chassis.

6. The materials handling vehicle as defined in claim 1 in which the two front ground engaging wheels and the two rear ground engaging wheels include elastomeric tires.

7. The materials handling vehicle as defined in claim 6 wherein the elastomeric tires are pneumatic tires.

8. A materials handling vehicle comprising:

a chassis;

two front ground engaging wheels;

two rear ground engaging wheels;

a front loading arm pivotally mounted relative to the chassis about a generally horizontal front loading arm axis extending laterally relative to the vehicle;

only a single rear arm, the rear arm being non-articulating and rigid, the rear arm having a first end mounted directly to a carriage, the single rear arm arranged to vertically pivot relative to the chassis about only a single generally horizontal first axis disposed adjacent the first end, the single rear arm also coupled to the carriage and arranged to horizontally pivot relative to the chassis about only a single generally vertical second axis; and a rotary piling rig attachment for removing spoil to form a hole, the rotary piling rig attachment being mounted by a pivot to a second end of the rear arm, all of the rotary piling rig attachment arranged to vertically pivot relative to the rear arm exclusively about only a single horizontal third axis defined by the pivot and extending parallel to the first axis, the third axis and the pivot being spaced from the first axis by a fixed distance, the third axis extending laterally through the pivot.

9. The materials handling vehicle of claim 8, including a quick hitch bracket attachably and detachably mounted to the pivot at the second end of the rear arm, and wherein the rotary piling rig attachment is rigidly mounted to the quick hitch bracket.

10. A materials handling vehicle comprising:

a chassis;

two front ground engaging wheels;

two rear ground engaging wheels;

a front loading arm pivotally mounted relative to the chassis about a generally horizontal front loading arm axis extending laterally relative to the vehicle;

only a single rear arm, the rear arm being rigid, the rear arm having a first end mounted directly to a carriage and arranged to pivot relative to the chassis about only a single generally horizontal first axis disposed adjacent the first end, the rear arm also coupled to the carriage and arranged to pivot relative to the chassis about only a single generally vertical second axis; and a rotary piling rig attachment for removing spoil to form a hole, the rotary piling rig attachment being mounted by a pivot to a second end of the rear arm, all of the rotary piling rig attachment arranged to pivot relative to the rear arm exclusively about only a single horizontal third axis defined by the pivot and extending parallel to the first axis, the third axis and the pivot being spaced from the first axis by a fixed distance, the third axis extending laterally through the pivot; and further including an actuator having a first end attached to the rear arm adjacent the first end of the rear arm, and a second end attached to the rotary piling rig adjacent and above the third axis, the actuator selectively operable to pivot the piling rig relative to the rear arm about the third axis.

11. The materials handling vehicle of claim 10, and further including a quick hitch bracket attachably and detachably mounted to the pivot at the second end of the rear arm, and wherein the rotary piling rig attachment is rigidly mounted to the quick hitch bracket, thereby enabling rapid attachment and detachment between the rotary piling rig and the rear arm.

12. A method of operating a materials handling vehicle, comprising:

providing a materials handling vehicle having a chassis, two front ground engaging wheels, two rear ground engaging wheels, a front loading arm pivotally mounted relative to the chassis about a generally horizontal front loading arm axis extending laterally relative to the vehicle, and a rear arm, the rear arm being only a single non-articulating rear arm;

arranging the rear arm to have a first end pivotally mounted relative to the chassis and a second end spaced a fixed distance away from the first end, wherein all of the rear arm is vertically pivotable relative to the chassis about only a single generally horizontal first axis, the rear arm also being horizontally pivotable relative to the chassis about only a single generally vertical second axis, providing a rotary piling rig for removing spoil to form a hole, mounting the rotary piling rig directly to the second end of the rear arm and arranging the rotary piling rig to pivot about a generally horizontal third axis extending parallel relative to the first axis and arranging the piling rig such that the third axis is the sole axis about which all of the piling rig pivots relative to the rear arm, and forming the rear arm such that the fixed distance between the second end and the first end results in the first axis and the third axis being spaced apart by a constant distance; and placing the rear arm in a first position;

commencing piling ground with the arm in the first position so as to collect spoil in the piling rig thereby creating a piled hole;

disengaging the piling rig from the piled hole;

pivoting the rear arm vertically downwards about the first axis; and discarding the spoil at a location spaced from the piled hole.

13. The method as defined in claim 12 including prior to discarding the spoil at the location spaced from the piled hole, horizontally pivoting the rear arm about the generally vertical second axis.

14. The method as defined in claim 12, including mounting the rear arm on a carriage, the carriage being translatable laterally relative to the chassis, and prior to discarding the spoil at the location spaced from the piled hole, translating the carriage laterally relative to the chassis.

15. The method as defined in claim 12, including providing the material handling vehicle with a chassis tipping system operable to tip the chassis laterally, the method including operating the tipping system prior to commencing piling ground with the arm in the first position so as to collect spoil in the piling rig thereby creating the piled hole, correctly aligning the rotary piling rig with a desired hole axis.

16. The method as defined in claim 12 including providing the front loading arm with a material handling implement engageable with the ground to tip the chassis longitudinally, the method including engaging the material handling implement with the ground prior to commencing piling ground with the arm in the first position so as to collect spoil in the piling rig thereby creating the piled hole so as to correctly align the piling rig with a desired hole axis.

17. The method as defined in claim 12, including providing the material handling vehicle with a chassis tipping system operable to tip the chassis laterally, the chassis tipping system including a right ground engaging stabilizing leg and a left ground engaging stabilizing leg, the method including, while disengaging the rotary piling rig from the ground, simultaneously extending the right ground engaging stabilizing leg and the left ground engaging stabilizing leg to at least partially disengage the piling rig from the piled hole.

* * * * *